US009435491B2

(12) United States Patent
Chang et al.

(10) Patent No.: US 9,435,491 B2
(45) Date of Patent: Sep. 6, 2016

(54) LED LEAD FRAME AND LAMP THEREOF

(71) Applicant: UNITY OPTO TECHNOLOGY CO., LTD., New Taipei (TW)

(72) Inventors: Wei Chang, New Taipei (TW); Chih-Hsien Wu, New Taipei (TW); Huan-Ying Lu, New Taipei (TW); Shih-Chao Shen, New Taipei (TW); Sen-Yuh Tsai, New Taipei (TW)

(73) Assignee: Unity Opto Technology Co., Ltd., New taipei (TW)

( * ) Notice: Subject to any disclaimer, the term of this patent is extended or adjusted under 35 U.S.C. 154(b) by 34 days.

(21) Appl. No.: 14/108,582

(22) Filed: Dec. 17, 2013

(65) Prior Publication Data

US 2015/0117007 A1 Apr. 30, 2015

(30) Foreign Application Priority Data

Oct. 25, 2013 (TW) ..... 102219936 U

(51) Int. Cl.

*F21K 99/00* (2016.01)
*F21V 19/00* (2006.01)
*F21V 21/00* (2006.01)

(52) U.S. Cl.

CPC ..... *F21K 9/13* (2013.01); *F21K 9/1355* (2013.01); *F21V 19/004* (2013.01); *F21V 21/00* (2013.01)

(58) Field of Classification Search

CPC ..... F21V 2111/001; F21V 19/004; F21V 21/00; F21Y 2111/007; F21Y 2111/005; F21Y 2111/004; F21Y 2111/002; F21Y 2111/001; F21K 9/13; F21K 9/135; F21K 9/1355

USPC ..... 362/249, 249.02, 235, 223, 249.06, 362/650, 363, 285

See application file for complete search history.

(56) References Cited

U.S. PATENT DOCUMENTS

| | | | | |
|---|---|---|---|---|
| 8,382,331 | B2 * | 2/2013 | Cheng | F21V 29/83 362/249.02 |
| 8,421,329 | B2 * | 4/2013 | Liang | F21K 9/135 313/317 |
| 9,123,868 | B2 * | 9/2015 | Pan | H01L 25/0753 |
| 2006/0214179 | A1 * | 9/2006 | Cao | 257/99 |
| 2009/0195186 | A1 * | 8/2009 | Guest et al. | 315/294 |
| 2010/0254133 | A1 * | 10/2010 | Cheng | 362/235 |
| 2011/0026253 | A1 * | 2/2011 | Gill | 362/249.02 |

(Continued)

FOREIGN PATENT DOCUMENTS

TW M460215 8/2013

*Primary Examiner* — Anh Mai
*Assistant Examiner* — Arman B Fallahkhair
(74) *Attorney, Agent, or Firm* — Rosenberg, Klein & Lee

(57) ABSTRACT

An LED lead frame mounted on a platform of a lightbulb includes a metal polarity substrate, a metal retaining substrate and a casing for partially covering the metal polarity substrate and the metal retaining substrate. The metal retaining substrate is a sheet bent into a disposing portion and a carrying portion, and an included angle $\theta_1$ is defined between the portions, and an abutting surface of the disposing portion abuts the platform, and a portion of the carrying portion not covered by the casing is provided for installing at least one LED chip. The metal polarity substrate is bent to form an included angle $\theta_2$, and $\theta_1=\theta_2$, and $93° \leq \theta_1 \leq 130°$. The casing has a support member formed on the casing and protruded in a direction opposite to the direction of bending the metal retaining substrate. The LED lead frame enhances the illumination angle and light uniformity of the lightbulb.

2 Claims, 8 Drawing Sheets

(56) References Cited

U.S. PATENT DOCUMENTS

2011/0215696 A1* 9/2011 Tong et al. ..... 313/46
2012/0043878 A1* 2/2012 Liang et al. ..... 313/317
2012/0193650 A1* 8/2012 Cheng ..... F21K 9/135 257/88
2013/0271991 A1* 10/2013 Hussell et al. ..... 362/249.02

* cited by examiner

LED LEAD FRAME AND LAMP THEREOF

CROSS-REFERENCE TO RELATED APPLICATIONS

This non-provisional application claims priority under 35 U.S.C. §119(a) on Patent Application No(s). 102219936 filed in Taiwan, R.O.C. on Oct. 25, 2013, the entire contents of which are hereby incorporated by reference.

BACKGROUND OF THE INVENTION

1. Field of the Invention

The present invention relates to the field of wide-angle illuminations, and more particularly to a light emitting diode (LED) lead frame and a lamp thereof capable of achieving a multi-directional illumination to increase the lateral illumination range.

2. Description of the Related Art

At present, most illumination lightbulbs adopt LED as an illumination light source to obtain uniform lights with a better color saturation. However, a conventional lightbulb is a point light source capable of achieving a 360-degree full directional light emission performance. On the other hand the LED is a plane light source with a limited range of diffusion angles, and thus it is a major issue for related manufacturers to improve the uniformity and illumination angle of the light source of a lightbulb.

Some countries set specifications (such as the Energy Star specification) for elements such as the light emitting angle and the brightness of the LED bulb to assure the light emitting performance. Therefore, the conventional LED bulb has to meet the minimum standard or requirement of the specification and tends to be designed with wide illumination angle and high light uniformity. A full directional LED lightbulb as disclosed in R.O.C. Pat. No. M460215 comprises a base, a circuit board, a light guide plate, at least one center LED, a plurality of peripheral LEDs and a lamp holder, wherein the light guide plate is installed on the circuit board, and each center LED installed on the circuit board is disposed in the light guide plate, and the lights are concentrated and projected to the front, and the peripheral LEDs disposed on the outer side of the light guide plate refracts light by a light reflective material on the outer side of the light guide plate to increase the light diffusion angle and the illumination angle.

The full directional LED lightbulb can improve the effect of the light diffusion angle and the illumination range by installing the LEDs at different positions (including the center LED and the peripheral LEDs together with the light guide plate). Since the volume of the LED is very small, therefore a lead frame is required in the manufacturing process and provided for connecting a conductive wire with an LED chip. However, the conventional LED lead frame has a light exit surface perpendicular to the surface of the circuit board, so that the center LED and the peripheral LEDs as disclosed in the foregoing patent emit light in a direction towards the lamp holder, and then the light guide plate is provided for changing the light diffusion path to achieve the aforementioned effect, and thus incurring a higher cost and consuming more assembling time, and the LEDs cannot produce the wide-angle light diffusion effect directly. Obviously, the light diffusion and illumination range of the conventional LED bulb have limitations and fail to obtain the best effect. Therefore, the inventor of the present invention based on years of experience in the related industry to conduct extensive researches and experiments, and finally developed an LED lead frame and a lamp thereof, in hope of overcoming the drawbacks of the conventional LED bulb.

SUMMARY OF THE INVENTION

In view of the problems of the prior art, it is a primary objective of the present invention to provide an LED lead frame mounted onto a platform and slightly tilted, and the LED lead frame comprises a metal retaining substrate, and the metal retaining substrate is bent to form a carrying portion and a disposing portion with an included angle defined between the carrying portion and the disposing portion, wherein the carrying portion is provided for installing at least one LED chip, and the disposing portion is attached onto a surface of the platform, and the included LED lead frame can increase the light projection angle of the LED chip.

Another objective of the present invention is to provide an LED bulb capable of enhancing the illumination angle and lateral light emission of the LED bulb by a lateral light emission lead frame and a forward light emitting lead frame, and the lead frames are arranged around the periphery of a platform, so that the LED bulb can achieve a full directional light emission effect.

To achieve the aforementioned objectives, the present invention provides an LED lead frame mounted onto a platform inside a lightbulb, and the LED lead frame comprises a metal polarity substrate, a metal retaining substrate and a casing for partially covering the metal polarity substrate and the metal retaining substrate, characterized in that the metal retaining substrate is a sheet bent into a disposing portion and a carrying portion, and an abutting surface of the disposing portion abuts the platform, and a portion of the carrying portion that is not covered by the casing is provided for installing at least one LED chip, and an included angle $\theta_1$ is defined between the disposing portion and the carrying portion; and the metal polarity substrate is bent to form an included angle $\theta_2$, wherein $\theta_1=\theta_2$, and $93° \leq \theta_1 \leq 130°$; and the casing includes a support member formed and protruded from a direction opposite to the direction of bending the metal retaining substrate.

Wherein, the support member is a wedge shaped member to provide a better support effect, and the casing has a weight member disposed at a position opposite to the support member and provided for preventing the LED lead frame from being tilted or toppled, and a sucking member formed at the other end of the casing and opposite to the disposing portion, and the sucking member has a sucking surface parallel to the abutting surface.

In another preferred embodiment, an LED bulb comprising a lamp holder and an electric socket is disclosed, wherein the lamp holder includes a platform installed therein, and a straight line passing through a center position of the platform and a tip position of the lamp holder is defined as the Z-axis, and the center is defined as the origin, and a direction facing the tip is defined as the positive direction of the Z-axis. The LED bulb comprises at least three lateral light emission lead frames arranged round the periphery of the platform, and the lateral light emission lead frames include a metal polarity substrate, a metal retaining substrate and a casing for partially covering the metal polarity substrate and the metal retaining substrate. Wherein, the metal retaining substrate is a sheet bent into a disposing portion and a carrying portion, and an abutting surface of the disposing portion abuts the platform, and a portion of the carrying portion not covered by the casing is provided for installing at least one LED chip, and an included angle $\theta_1$ is defined between the disposing portion and the carrying portion, and the metal polarity substrate is bent to form an included angle $\theta_2$, and $\theta_1=\theta_2$, and $93°\leq\theta_1\leq130°$; and the casing has a support member formed on the casing and protruded in a direction opposite to the direction of bending the metal retaining substrate. In addition, at least one forward light emitting lead frame is mounted onto the platform and has a light emitting area, and an exit light direction of the light emitting area faces the positive direction of the Z-axis.

Wherein, the support member is a wedge shaped member, and the casing further includes a weight member disposed at a position opposite to the support member, and a sucking member formed at a position of opposite to the other end of the disposing portion, and the sucking member has a sucking surface, and after the disposing portion abuts the platform, the sucking surface is parallel to the platform.

DETAILED DESCRIPTION OF THE PREFERRED EMBODIMENTS

Figure 1:
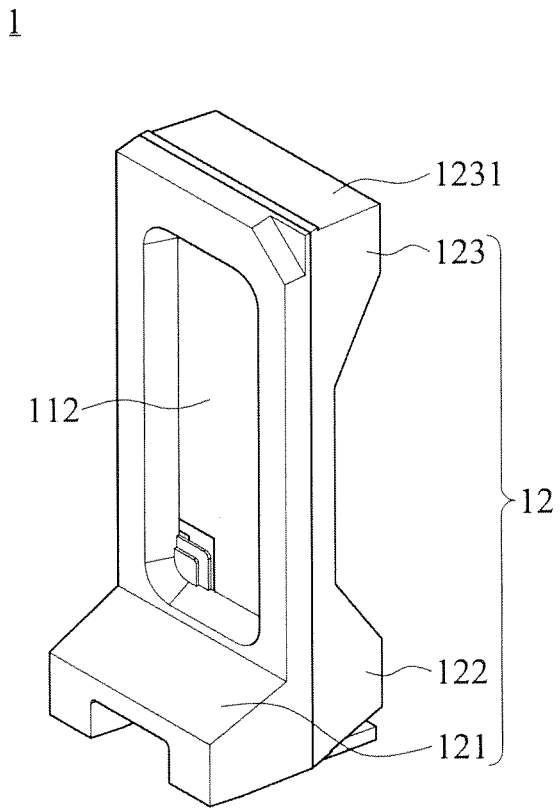
FIG. 1 is a first perspective view of a first preferred embodiment of the present invention.
Figure 2:
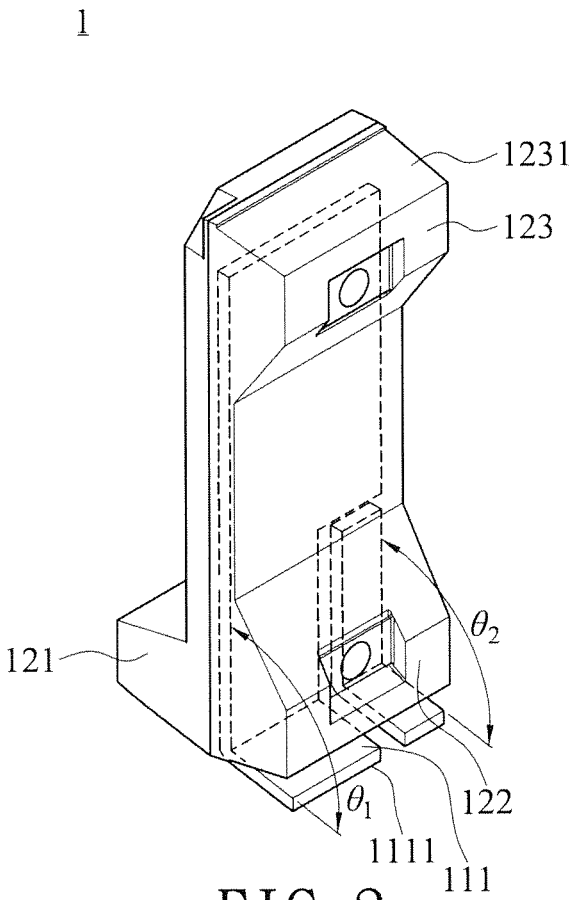
FIG. 2 is a second perspective view of the first preferred embodiment of the present invention.
Figure 3:
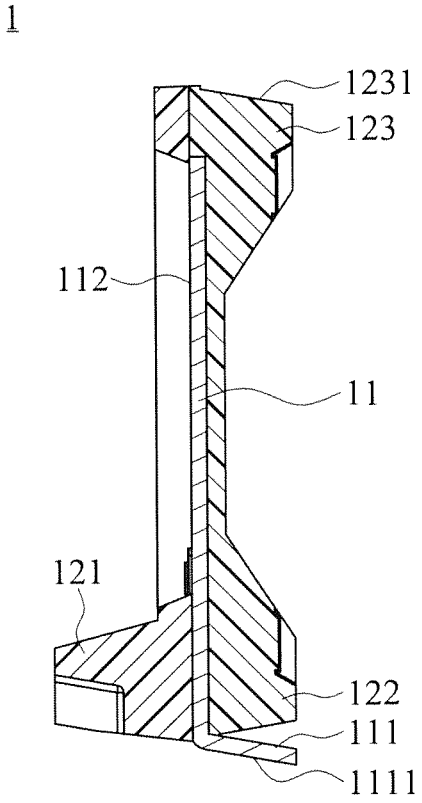
FIG. 3 is a sectional view of the first preferred embodiment of the present invention.
Figure 4:
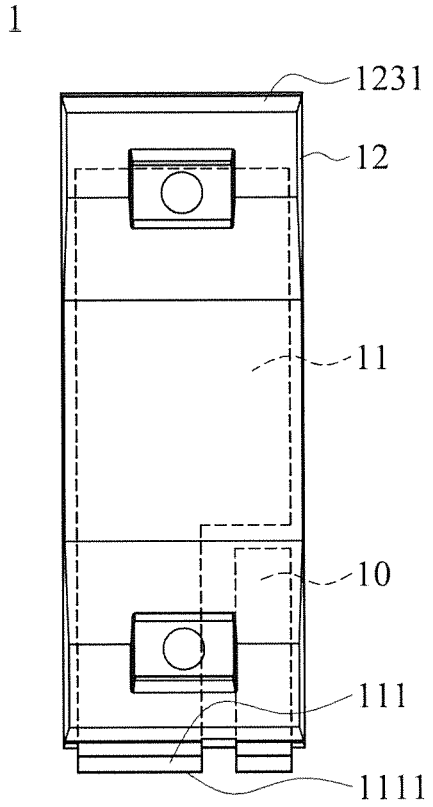
FIG. 4 is a rear view of the first preferred embodiment of the present invention.
Figure 5:
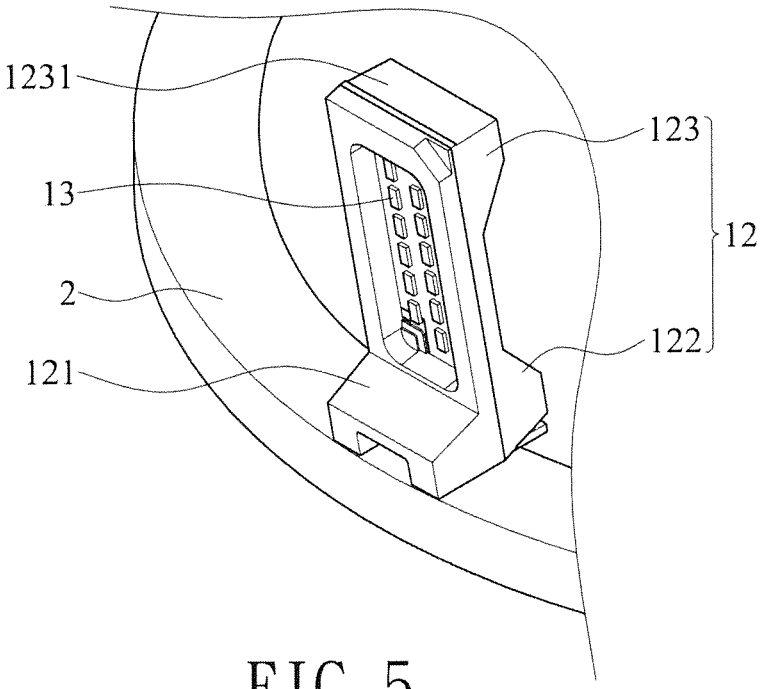
FIG. 5 is a schematic view of an application of the first preferred embodiment of the present invention.

The technical content of the present invention will become apparent with the detailed description of preferred embodiments and the illustration of related drawings as follows.

With reference to FIG. 1 to 5 for the first and second perspective views, sectional view, and rear view of an LED lead frame and the schematic view of an application of the LED lead frame in accordance with the first preferred embodiment of the present invention respectively, the LED lead frame 1 is mounted onto a platform 2 inside a lightbulb, and the LED lead frame 1 has a metal polarity substrate 10, a metal retaining substrate 11 and a casing 12 provided for partially covering the metal polarity substrate 10 and the metal retaining substrate 11.

The LED lead frame 1 is characterized in that the metal retaining substrate 11 is a sheet structure bent into a disposing portion 111 and a carrying portion 112, and an abutting surface 1111 of the disposing portion 111 abuts the platform 2 to fix the LED lead frame 1 onto the platform 2. A portion of the carrying portion 112 not covered by the casing 12 is provided for installing at least one LED chip 13. In this preferred embodiment, there are multiple LED chips 13 disposed on the carrying portion 112. However, the quantity of LED chips 13 of the present invention is not limited to any particular quantity. An included angle $\theta_1$ is defined between the disposing portion 111 and the carrying portion 112, and the metal polarity substrate 10 is bent to form an included angle $\theta_2$, wherein $\theta_1=\theta_2$, and $93°\leq\theta_1\leq130°$, so that after the LED lead frame 1 is mounted onto the platform 2, the LED lead frame 1 is slightly tilted to improve the illumination angle provided by the LED lead frame 1. In addition, the casing 12 includes a support member 121 formed on the casing 12 and protruded in a direction opposite to the direction of bending the metal retaining substrate 11 for providing a support force after the LED lead frame 1 is mounted onto the platform 2 to prevent the LED lead frame from being tilted or toppled or affecting the illumination angle of the LED chips 13. Preferably, the support member 121 is a wedge shaped member, but the shape of the support member 121 of the present invention is not limited to the wedge shape only.

It is noteworthy that the casing 12 further includes a weight member 122 disposed at a position opposite to the support member 121, so that the LED lead frame 1 can be installed securely with a better balance, and after the LED lead frame 1 is attached onto the platform 2, the weight member 122 is provided for balancing the total weight of the LED lead frame 1 to prevent the LED lead frame 1 from inclining towards a certain direction or affecting the light emitting angle of the LED chips 13.

In addition, the casing 12 includes a sucking member 123 formed at the other end of the casing 12 and opposite to the disposing portion 111, and the sucking member 123 has a sucking surface 1231 parallel to the abutting surface 1111. The sucking surface 1231 is provided for an installing mechanism to suck and place the LED lead frame 1 at a specified position of the platform 2. Since the whole LED lead frame 1 is tilted, therefore if the LED lead frame 1 is sucked horizontally during an installation process, then after the LED lead frame 1 is mounted onto the platform 2, the LED lead frame 1 will be tilted instead and unable to maintain a required angle, and the abutting surface 1111 will not be attached tightly to the platform 2. Therefore, the sucking surface 1231 designed to be parallel to the abutting surface 1111 can assure that the abutting surface 1111 of the disposing portion 111 is attached to a surface of the platform 2 completely when the LED lead frame 1 is attached and secured to the platform 2.

Figure 6:
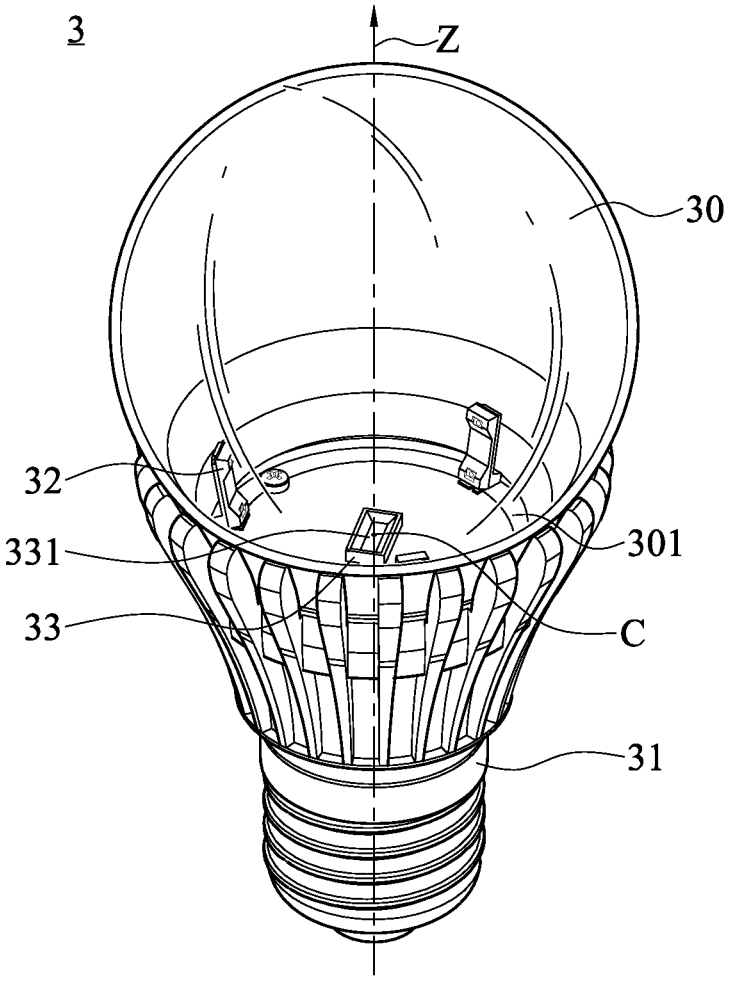
FIG. 6 is a perspective view of a second preferred embodiment of the present invention.
Figure 7:
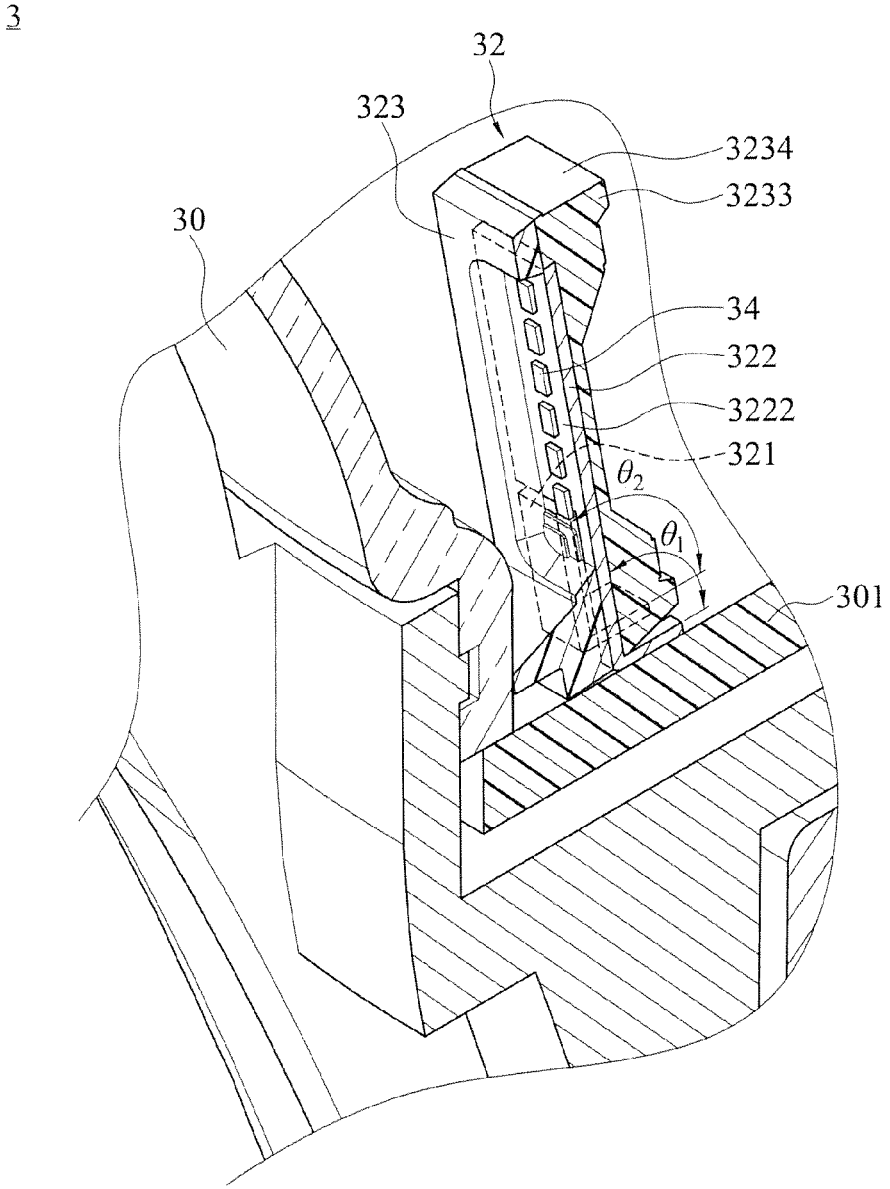
FIG. 7 is a sectional view of the second preferred embodiment of the present invention.

With reference to FIGS. 6 and 7 for the perspective view and sectional view of an LED bulb in accordance with the second preferred embodiment of the present invention, the LED bulb 3 comprises a lamp holder 30 and an electric socket 31, and the lamp holder 30 includes a platform 301 installed therein, wherein a straight line passing through a center position of the platform 301 and a tip position of the lamp holder 30 is defined as the Z-axis, and the center is defined as the origin, and the direction facing the tip is defined as the positive direction of the Z-axis. The LED bulb 3 includes at least three lateral light emission lead frames 32 and at least one forward light emitting lead frame 33.

The lateral light emission lead frames 32 are disposed around the periphery of the platform 301 and the lateral light emission lead frames 32 include a metal polarity substrate 321, a metal retaining substrate 322 and a casing 323 for partially covering the metal polarity substrate 321 and the metal retaining substrate 322, wherein the metal retaining substrate 322 is a sheet bent into a disposing portion 3221 and a carrying portion 3222, and the disposing portion 3221 abuts the platform 301, and a portion of the carrying portion 3222 not covered by the casing 323 is provided for installing at least one LED chip 34, and an included angle $\theta_1$ is defined between the disposing portion 3221 and the carrying portion 3222, and the metal polarity substrate 321 is bent to form an included angle $\theta_2$, and $\theta_1=\theta_2$, and $93°\leq\theta_1\leq130°$. The included angle between the disposing portion 3221 and the carrying portion 3222 makes the lateral light emission lead frames 32 to be tilted to improve the light exit angle of the LED bulb 3 and provide an excellent surrounding light. In addition, the casing 323 has a support member 3231 formed on the casing 323 and protruded in a direction opposite to the direction of bending the metal retaining substrate 322.

The forward light emitting lead frames 33 are also mounted onto the platform 301 and each forward light emitting lead frame 33 includes a light emitting area 331, and the light exit direction of the light emitting areas 331 faces the positive direction of the Z-axis to provide a forward light of the LED bulb 3. With the wide-angle light of the lateral light emission lead frames 32, the LED bulb 3 can achieve the effect of a wide illumination angle.

Wherein, the support member 3231 is a wedge shaped member provided for achieving a better supporting effect, and the casing 323 includes a weight member 3232 disposed at a position opposite to the support member 3231 for balancing the total weight of the lateral light emission lead frames 32, such that the lateral light emission lead frames 32 can be mounted securely onto the platform 301 to prevent the a tilted disposing portion 3221 from being unable to attach onto the platform 301 after the support member 3231 is assembled. In addition, the casing 323 includes a sucking member 3233 formed on the casing 323 and disposed at a position opposite to the other end of the disposing portion 3221, and the sucking member 3233 has a sucking surface 3234. After the disposing portion 3221 abuts the platform 301, the sucking surface 3234 is parallel to the platform 301. In an installation, an installing mechanism sucks the lateral light emission lead frames 32 from the sucking surfaces 3234 respectively and places them onto the platform 301 one by one. Since the sucking surface 3234 is parallel to the platform 301, therefore the disposing portion 3221 can be attached securely to the platform 301 after the lateral light emission lead frames 32 are placed onto the platform 301.

Wherein, the present invention has at least three lateral light emission lead frames 32 installed around the platform 301. Preferably, the forward light emitting lead frame 33 is disposed at the center of the platform 301 and surrounded by the lateral light emission lead frames 3, so that the LED bulb 3 can achieve the effects of a uniform lighting and a wide illumination angle without requiring the installation of additional components.

Figure 8:
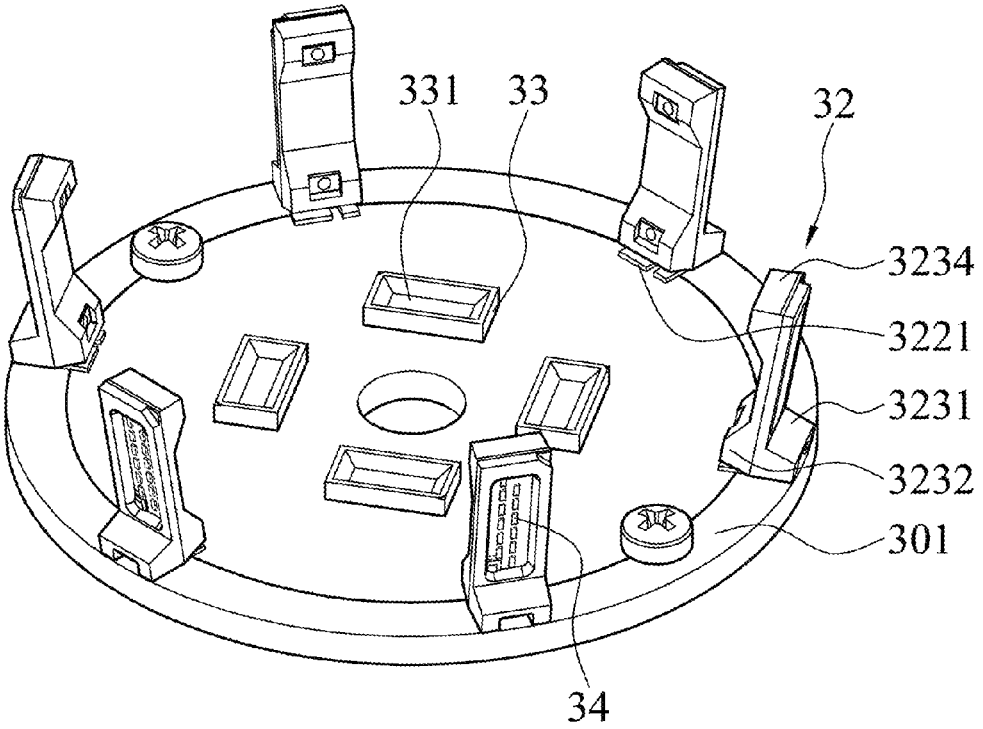
FIG. 8 is a schematic view of another implementation mode of a platform and each lead frame in accordance with the second preferred embodiment of the present invention.

With reference to FIG. 8 for a schematic view of another implementation mode of a platform and each lead frame in accordance with the second preferred embodiment of the present invention, there are three or more lateral light emission lead frames 32 depending on actual requirements of this embodiment and multiple forward light emitting lead frame 33 to provide higher brightness and wider illumination angle. In FIG. 7, the lateral light emission lead frames 32 are arranged equidistantly around the periphery of the platform 301, and the forward light emitting lead frames 33 are arranged at the center of the platform 301 and surrounded by the lateral light emission lead frames 32.

What is claimed is:

1. A light emitting diode (LED) lead frame, mounted onto a platform inside a lightbulb, and comprising a metal polarity substrate, a metal retaining substrate and a casing for partially covering the metal polarity substrate and the metal retaining substrate, characterized in that the metal retaining substrate is a sheet bent into a disposing portion and a carrying portion, and an abutting surface of the disposing portion abuts the platform, and a portion of the carrying portion not covered by the casing is provided for installing at least one LED chip, and an included angle $\theta_1$ is defined between the disposing portion and the carrying portion, and the metal polarity substrate is bent to form an included angle $\theta_2$, and $\theta_1=\theta_2$, and $93°\leq\theta_1=130°$; and the casing has a support member formed on the casing and protruded in a direction opposite to the direction of bending the metal retaining substrate, wherein the support member is a wedge shaped member, the casing further includes a weight member formed on the casing and disposed at a position opposite to the support member, wherein the casing includes a sucking member formed on the casing and disposed at a position opposite to the other end of the disposing portion, and the sucking member is a wedge shaped member protruding in a direction toward a center of the platform and has a sucking surface parallel to the abutting surface.

2. A light emitting diode (LED) bulb, comprising a lamp holder and an electric socket, and the lamp holder having a platform installed therein, and a straight line passing through a center position of the platform and a tip position of the lamp holder being defined as the Z-axis, and the center being defined as the origin, and a direction facing the tip being defined as the positive direction of the Z-axis, comprising:

at least three lateral light emission lead frames, disposed around the periphery of the platform, and having a metal polarity substrate, a metal retaining substrate and a casing for partially covering the metal polarity substrate and the metal retaining substrate, wherein the metal retaining substrate is a sheet bent into a disposing portion and a carrying portion, and the disposing portion abuts the platform, and a portion of the carrying portion not covered by the casing is provided for installing at least one LED chip, and an included angle $\theta_1$ is defined between the disposing portion and the carrying portion, and the metal polarity substrate is bent to form an included angle $\theta_2$, and $\theta_1=\theta_2$, and $93°\leq\theta_1\leq130°$; and the casing has a support member formed on the casing and protruded in a direction opposite to the direction of bending the metal retaining substrate; and at least one forward light emitting lead frame, mounted onto the platform, and having a light emitting area, and an exit light direction of the light emitting area faces the positive direction of the Z-axis, wherein the support member is a wedge shaped member, the casing further includes a weight member disposed at a position opposite to the support member, wherein the casing includes a sucking member formed on the casing and disposed at a position opposite to the other end of the disposing portion, and the sucking member is a wedge shaped member protruding in a direction toward a center of the platform and has a sucking surface, such that after the disposing portion abuts the platform, the sucking surface is parallel to the platform.

* * * * *